US006767296B1

(12) United States Patent
Johnson

(10) Patent No.: US 6,767,296 B1
(45) Date of Patent: Jul. 27, 2004

(54) BASEBALL BASE SECURING DEVICE

(76) Inventor: Dennis A. Johnson, P.O. Box 2586, Orange, CA (US) 92859

( * ) Notice: Subject to any disclaimer, the term of this patent is extended or adjusted under 35 U.S.C. 154(b) by 7 days.

(21) Appl. No.: 10/346,478

(22) Filed: Jan. 17, 2003

(51) Int. Cl.[7] ..... A63B 71/00
(52) U.S. Cl. ..... 473/499; 52/169.13
(58) Field of Search ..... 473/499, 500–501, 473/504, 490; 135/139, 98–99, 127; 24/620, 629; 411/508, 14.5; 52/166, 169.13; 404/11; 248/530, 533

(56) References Cited

U.S. PATENT DOCUMENTS

| | | | | | |
|---|---|---|---|---|---|
| 4,060,244 | A | | 11/1977 | Graham | |
| 4,531,733 | A | * | 7/1985 | Hall | 473/501 |
| 4,690,403 | A | * | 9/1987 | Meggs | 473/501 |
| 4,723,779 | A | * | 2/1988 | Hauser | 473/499 |
| 4,830,368 | A | * | 5/1989 | Green et al. | 473/501 |
| 5,203,557 | A | | 4/1993 | Studebaker et al. | |
| 5,415,394 | A | | 5/1995 | Hall | |
| 5,456,460 | A | * | 10/1995 | Larsen | 473/499 |
| 5,556,089 | A | | 9/1996 | Hall | |
| 5,590,874 | A | | 1/1997 | Hall | |
| 5,800,288 | A | * | 9/1998 | Mims | 473/417 |
| 5,967,910 | A | * | 10/1999 | Lin | 473/417 |
| 6,077,175 | A | | 6/2000 | Fearnow | |

OTHER PUBLICATIONS (Internet Literature) Schutt Sports, "Holywood Bases," pp. 1 of 1.

* cited by examiner

*Primary Examiner*—Stephen P. Garbo
*Assistant Examiner*—M. Chambers
(74) *Attorney, Agent, or Firm*—Stetina Brunda Garred & Brucker

(57) ABSTRACT

The present invention provides a baseball base securing device comprising a buried hollow receiving tube and a spring biased cover. Generally, the baseball base, having a downwardly extending anchor member is receivable by and removable from the receiving tube. The spring biased cover is insertable into the receiver and positionable between a flush position and a retracted position within the receiver. The cover is in the flush position just under the surface, when the anchor of the baseball base is removed from the receiver. The cover is traversed to the retracted position when the anchor of the baseball base is inserted into the receiving tube. The cover, including a air permeable seal around the perimeter, and in contact with the sidewall of the receiving tube pushes dirt out from the receiving tube when the anchor of the base is being removed therefrom, and the cover prevents environmental debris or dirt from entering the receiver when the anchor is not inserted into the receiver.

14 Claims, 3 Drawing Sheets

BASEBALL BASE SECURING DEVICE

CROSS-REFERENCE TO RELATED APPLICATIONS (Not Applicable)

STATEMENT RE: FEDERALLY SPONSORED RESEARCH/DEVELOPMENT (Not Applicable)

FIELD OF THE INVENTION

The present invention relates generally to an apparatus and method securing sports equipment to a field playing surface. More particularly, the invention comprises an improved apparatus and method for removably securing a baseball base to the infield of a baseball field.

BACKGROUND OF THE INVENTION

Baseball is a popular sport in the United States and internationally. The sport is played at many levels beginning from children's amateur baseball through college and professional baseball. In the more organized baseball leagues, bases are secured to the baseball field to prevent movement during the game. A variety of devices have been adapted to allow bases to be secured and then later removed.

The necessity to provide bases that are removably attachable to the playing field arises for a number of reasons. It is desirable to remove the base from the field to avoid prolonged exposure to the environment which would have a deleterious effect on the base. Further, many fields are multipurpose sports fields and it is important to be able to remove the bases to allow other sports to be played without the base secured to the field. Also, during maintenance of the field's surface, it is desirable to remove the bases.

In order to be removably attachable to the playing surface, conventional bases include base anchors affixed to the bottom surface of the base to secure the base to the ground. A number of known base anchors are used to secure bases. Most typically, bases include a male square metal shaft protruding downwardly from the bottom of the center of the base. A square hollow female shaft embedded vertically in the ground receives male shaft via an opening slightly larger than the male shaft. The bottom of the hollow female shaft is installed approximately one to one and a half feet below field grade and is usually set in cement and placed at first, second and third base locations of a playing field. It is estimated that currently, the above described base and anchor is used in approximately 90% of fields used by organized baseball leagues.

The above described female shaft anchors are set in the ground at designed base locations depending on the level of play. For example, fields may have a distance of 54 feet for little league play, 60 feet for girls softball, 65 feet for mens softball,70 and 80 feet of Pony level baseball and 90 feet for highschool and major league baseball. The anchors are permanently installed in the ground to accommodate the base for what ever level of game is played. A playing field may have 5 or 6 different anchor locations at one time but only one set of bases is set at a time.

After use, the base is removed from the female shaft and a rubber plug is installed in the opening of the female shaft in order to prevent debris from falling into the hollow void thereof. The base is stored for use in the next game. The rubber plugs vary in size from 2 inches in diameter to 6 in diameter, and approximately one inch in height. Square plugs are also utilized. With the rubber plugs in place, the dirt area of the playing field is raked and machine dragged in order to keep the field flat and ready for the next teams use. While the field is being raked and dragged the buried female base anchors are covered with dirt and left covered until the next games are played. In many instances, the fields are raked and dragged by the players or coaches who may easily lose the rubber plugs or they may easily forget to install the plugs and the anchors fill with dirt and rocks. In some cases rakes or dragging equipment will snag the plugs removing them, and causing the void to fill with unwanted material.

The filling of the void of the buried female shaft with unwanted material is so prevalent that manufacturers of baseball bases and accompanying anchors sell a small spoon to be used in conjunction with the equipment in order to remove the dirt and debris. Removing of the debris with the spoon device is difficult and time consuming. Each time the field is used, someone must first locate the desired anchor by measuring from a permanently installed home base to the general area of the anchor. The anchor is located by random prodding in the dirt in the general location. Once the plug is removed, the base shaft is placed into the anchor and pushed down to ground level and it is ready for use, sometimes with great difficulty. Frequently debris gets into the shaft of the anchor when removing the plug in which case the small spoon is used to remove the soil. In many cases, if the dirt and rocks are not removed completely, the installers must use great force to push the bases down to ground level. Dirt and rocks may wedge between the anchor shaft and the base shaft and can not be pulled apart. When this happens, the ground anchor must be unburied, removed from the field and new anchor installed. The removed anchor is then discarded, most times along with the frozen base.

Because the amateur leagues do not have the benefit of professional grounds keepers, the securing and later removal of the bases to the field surface must be completed by league officials, coaches, umpires or the players themselves. Thus, there is a great need to provide a baseball base securing device which prevents unwanted dirt and debris from entering the open vertical shaft thus, reducing the time and effort associated with base installation. In addition, there is a great need to provide a base securing device which eases the identification of a buried base shaft.

BRIEF SUMMARY OF THE INVENTION

The present invention relates to a baseball base securing device which is engageable with a baseball base. The present invention is utilized with a standard baseball base having a downwardly extending anchor which is received by a hollow buried receiving tube member of the present invention. The receiving tube has an aperture which is sized and configured to receive the anchor. When not in use, a cover closes off the receiving tube. The cover is supported by a spring member located within the body of the receiving tube. The cover is traversable between a flush position and a retracted position. The cover is biased such that the flush position is normal. The cover is biased with a compression spring.

The spring defines a biasing force at the flushed position and the retracted position. Generally, the spring force at the flush position is sufficient to push dirt out from the aperture, and the spring force at the retracted position is less than a total weight of the base. A collapsible cord is attached to the cover to regulate the cover to the flushed position.

The cover has a cross-sectional dimensions virtually identical to that of the base's downwardly extending member which is received by the aperture of the receiving tube. As such, the aperture is configured as a square hole. Specifically, the size of the cover is slightly smaller than the size of the aperture of the receiver such that the cover may be inserted into the receiver and traversable between a flush position and the retracted position. In this regard, when the anchor of the base is removed from the receiver, the cover pushes debris and dirt out of the receiver as the anchor is being removed from the housing.

A flexible seal circumvents the cover. In particular, the seal continuously contacts the outside perimeter of the cover and the inside perimeter of the aperture and inside surface of the receiving tube. The seal is fabricated from a material that is resilient and weather resistant. Additionally, the seal should be permeable to air but not dirt and other debris. In this regard, the seal further displaces dirt out from the receiver as the anchor is being removed from the housing. By way of example and not limitation, the seal may be fabricated from foam, rubber, closed cell rubber or open cell rubber.

A visual indicator is attached to the receiving tube. The locator is attached to the receiver such that it is visible above the dirt when the anchor is removed from the housing. The visual indicator has long bristles that are resilient such that it may deform when the bases is inserted into the housing and resiliently push above the surface of the ground when the base is removed therefrom. Typically the locator is oriented and attached to the housing such that the locator is normal to the ground.

BRIEF DESCRIPTION OF THE DRAWINGS

These as well as other features of the present invention will become more apparent upon reference to the drawings wherein.

DETAILED DESCRIPTION OF THE INVENTION

The detailed description as set forth below in connection with the appended drawings is intended as a description of the presently preferred embodiments of the present invention, and does not represent the only embodiment of the present invention. It is understood that various modifications to the invention may be comprised by different embodiments and are also encompassed within the spirit and scope of the present invention.

Figure 1:
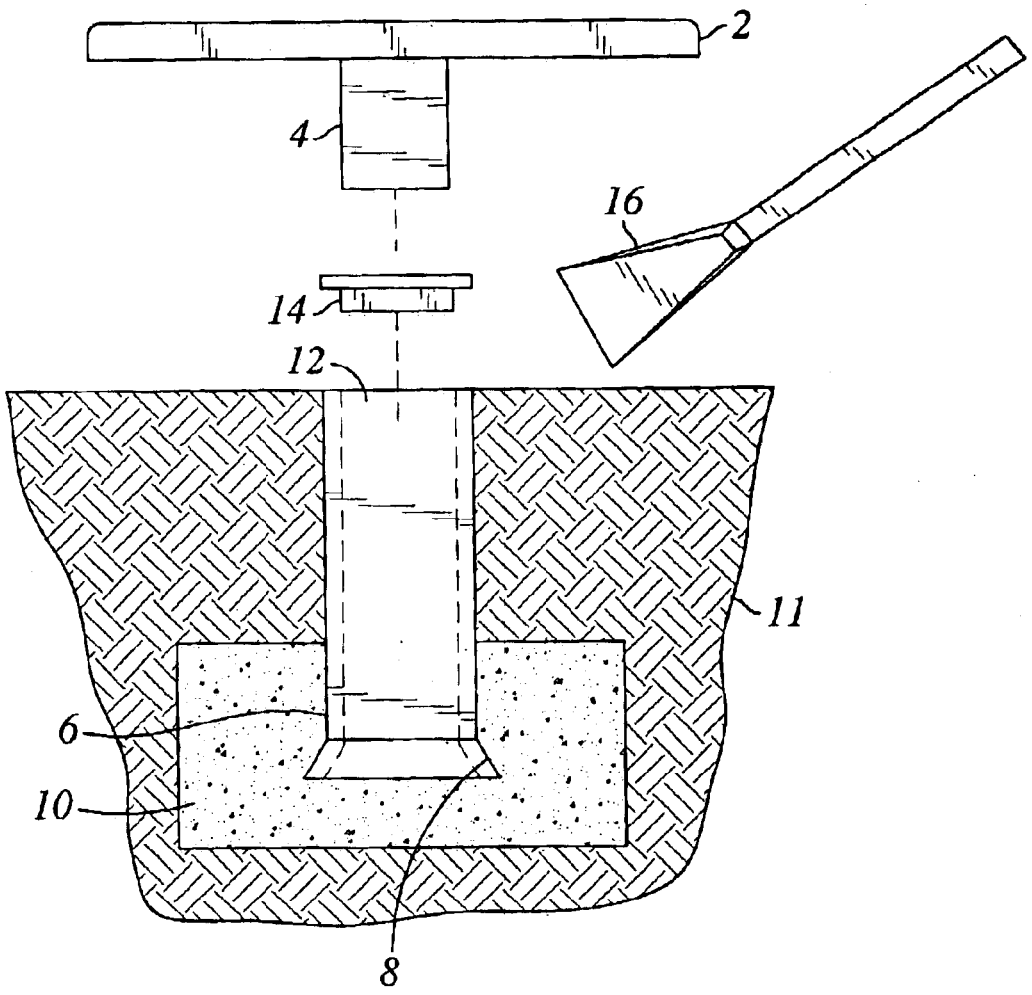
(PRIOR ART) Fig. 1
FIG. 1 is a perspective view of a prior art baseball base securing system.

The most common baseball base securing device used in present day amateur baseball is shown FIG. 1 (prior art). The problems associated with the use of the prior art device shown in FIG. 1 is discussed in detail in the Background. FIG. 1 shows a common method of removably securing a baseball base to the playing field. A base 2 having an elongate anchor 4 protrudes below the bottom surface of the base 2 and is engageable with receiving tube 6. In order to secure the receiving tube 6 to the field, the tapered bottom end 8 of the receiving tube 6 is inserted into cement to form block 10. The tapered bottom end 8 aids in securing the receiving tube 6 within the cement block 10. The cement block 10 along with the receiver tube 6 is buried into the ground 11 of the playing field.

While the base 2 is secured in the receiving tube 6, dirt and other debris from the environment will enter the receiving tube 6 through the aperture 12. After play, the anchor 4 may be pulled out of the receiving tube 6 for storage. Dirt and other debris that enters the receiving tube 6 during play still resides therein. In this regard, the dirt that entered the aperture 12 of the receiver 6 at times wedges itself in between the anchor 4 and the walls of the receiving tube 6 such that removal of the anchor 4 from the receiving tube 6 may be impossible. When the bases 2 are in storage, a rubber stopper 14 is placed over the aperture 12 of the receiving tube 6 so as to prevent debris from the environment from entering the aperture 12. When the base 2 needs to be reinserted, the dirt and debris that entered the aperture 12 of the receiving tube 12 must be removed such that the anchor 4 of the base 2 may be inserted into the aperture 12 of the receiving tube 6. Typically, the removal of the dirt and other debris is accomplished with a specially adapted spoon 16.

Figure 2:
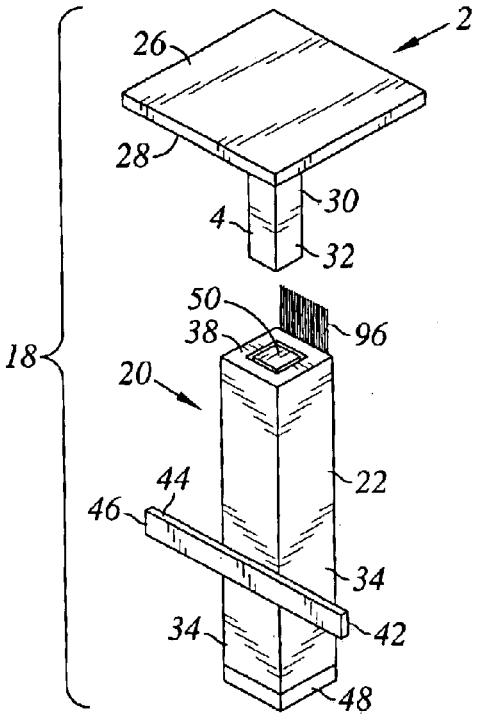
FIG. 2 is a perspective view of the base securing system of the present invention.

Referring to the drawings for the purposes of illustrating preferred embodiments of the present invention and not for the purposes of limiting alternative embodiments within the spirit and scope of the invention, in particular, FIG. 2 depicts a perspective view of the baseball base securing device 20 of present invention. In an embodiment of the present invention, a base system 18 is provided wherein the same includes a standard base 2 (see FIG. 1) and a base securing device 20. The base 2 includes an anchor 4. The base securing device 20 comprises a receiving tube 22 and a cover 50.

Typically, the base system 18 is utilized in an environment which has an abundant supply of debris which potentially may fall into the internal mechanism of the base securing device 20. For example, the base system 18 may be used to secure base 2 used in the game of baseball to a playing field. In this regard, commonly, the base system 18 is surrounded by lose dirt or other debris.

In relation to the base 2, the same defines opposed top and bottom surfaces 26, 28 (see FIG. 2) and a central segment (not shown). The anchor 4 is physically attached to the bottom surface 28 of the base 2. In particular, the anchor 4 is perpendicularly attached thereto at the central segment (not shown). The physical attachment between the base 2 and the anchor 4 must be sufficient to withstand the forces applied to the base 2 during its normal course of use. For example, in relation to baseball, the physical connection must be sufficient for a player to step on and slide into the base 2. The anchor 4 defines a body portion 30 and a distal end portion 32. The anchor 4 is generally an elongate member having a square cross section. The base 2 is standard and widely used, and is the same base described in association with the prior art device of FIG. 1.

Figure 3:
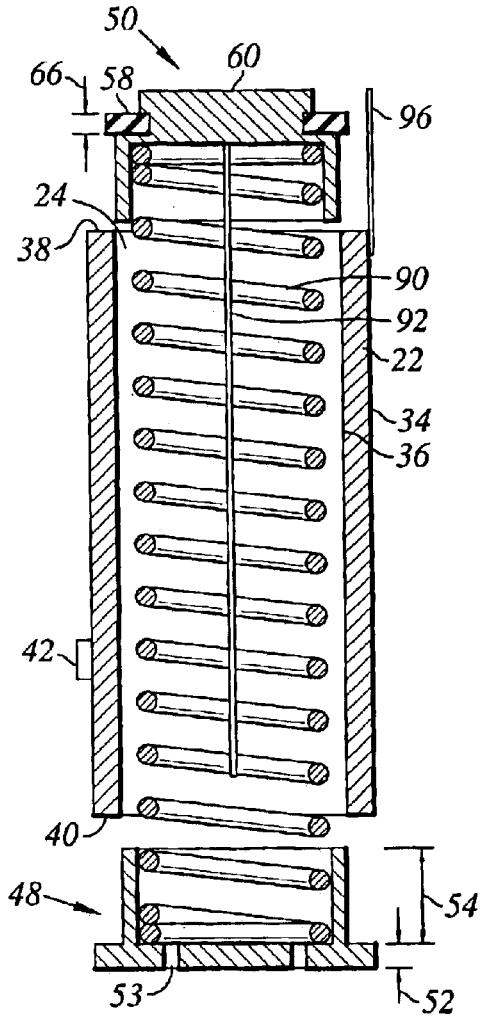
FIG. 3 is an exploded cross sectional view of the receiving tube of the present invention.

Referring particularly to FIGS. 2 and 3, the receiving tube 22 is an elongate member having an aperture 24 defining a generally square tube. The receiving tube 22 defines an outside surface 34, inside surface 36, and opposed top and bottom surfaces 38 and 40. An aperture 24 extends from the top surface 38 to the bottom surface 40 of the receiving tube 22. The aperture 24 is sized to receive the anchor 4 of the base 2. In the shown embodiment, the anchor 4 and receiving tube 22 have square cross sections to allow the mating of the anchor 4 into the aperture 24 of the receiving tube 22; however, it is contemplated by the present invention that the anchor 4 may have another shape, and the receiving tube 22 would like wise be a hollow tube with a shape to match the cross sectional shape of the anchor 4 to facilitate the matching of the tube 22 and anchor 4.

The square configuration of the receiving tube 22 is sized such that the anchor 4 may be inserted therein with a snug fit. In this regard, the largest cross section of the anchor 4 is less than the size of the aperture 24 of the receiving tube 22. The size differential between the anchor 4 and aperture 24 of the receiving tube 22 is such that dirt and other small particles do not prevent the anchor 4 from sliding out from the aperture 24 of the receiving tube 22. In particular, when the anchor 4 is inserted into the aperture 24 of the receiving tube 22, dirt and other debris may work its way in between the anchor 4 and the inside surface 36 of the receiving tube 22. In the prior art, dirt and other debris that works between the anchor 4 and the inner wall of the receiving tube 6 creates friction which increases the force required to remove the anchor 4 from the tube 6. In the embodiment shown in the present invention, the aperture 24 and the inner cross section of the receiving tube 22 is greater than a standard sized aperture 24 of a standard receiving tube 6 to avoid friction problems associated with debris.

The top surface 38 of the receiving tube 22 defines the aperture 24. The base securing device 20 is buried into the ground 11 such that the top surface 38 is below the level of the ground 11 such that players will not trip over unused base securing devices 20 at other locations on the playing field. Preferably, the top surface 38 is approximately one inch to two and one half inches below the level of the ground. Additionally, when the anchor 4 is fully inserted into the aperture 24 of the receiving tube 22, the bottom surface 28 of the base 2 rests upon the ground and not upon the top surface 38 of the receiving tube 22. As discussed above, the anchor 4 is perpendicularly attached to the base 2. The receiving tube 22 is formed from a square metal tube, and it is contemplated that it may be manufactured from any rigid material such as steel, aluminum, plastics, or any other suitable material for which the base system 18 will be used.

Figure 5:
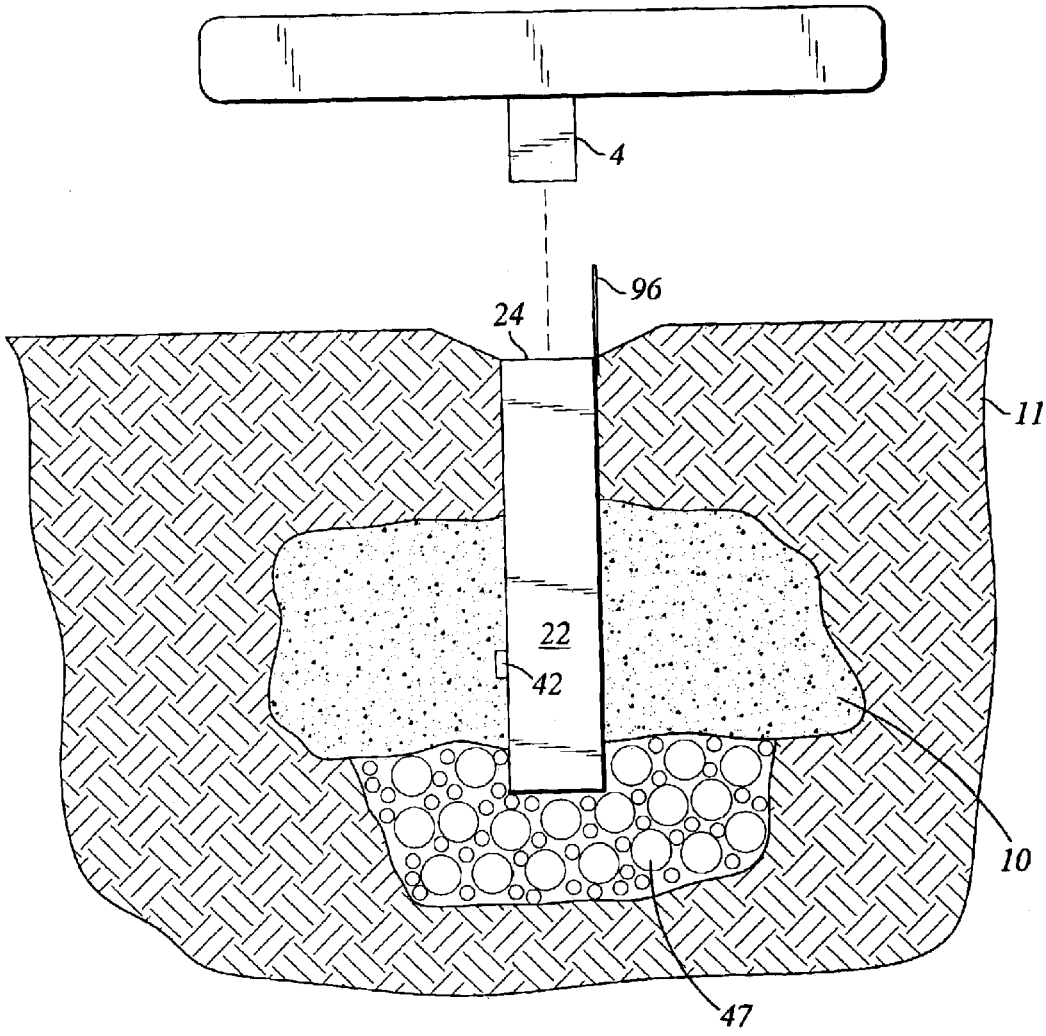
FIG. 5 is a perspective view of an embodiment of the baseball base securing system.

The outside surface 34 of the receiving tube 22 includes a elongate rigid bar 42 of flat metal affixed generally perpendicular to the receiving tube 22. Preferably, the bar 42 is a flat rectangular sheet of rigid material having opposed pairs of longitudinal and lateral edges 44, 46. Although a flat member is contemplated, any elongate bar may be used. The bar 42 is attached to the outside surface 34 of the receiving tube 22. The bar 42 is affixed to the bottom portion of the receiving tube 22 such that the bar 42 is located within the cement block 10 (see FIG. 5). By way of example and not limitation, the bar 42 may be attached to the receiving tube 22 through welding. In use, the bottom portion of the receiving tube 22 is set in cement to form the block 10. As shown in FIG. 5, the distal end of the bottom portion of the receiving tube 22 is not set in cement. The resultant cement block 10 (shown in FIG. 5) and the exposed portion of the receiving tube 22 is buried in the ground 11 with the aperture 24 exposed to the surface for receiving a base anchor 4. The distal end of the bottom portion of the receiving tube 22 which is not set in cement is placed in gravel 47. A purpose of the bar 42 is to prevent the removal of the receiving tube 22 from the cement block 10. Additionally, the bar 42 prevents rotational movement of the receiving tube 22 within the cement block 10. The bar 42 may be manufactured from any rigid material such as metal, steel, aluminum, plastics or any other suitable material for which the base system 18 will be used.

Referring to FIGS. 2 and 3, disposed on the bottom surface 40 of the receiving tube 22 is a bottom plate 48. One of the purposes of the bottom plate 48 is to retain the spring 90 within the receiving tube 22. The bottom plate 48 includes a sheet portion 52 and a protrusion portion 54. The protrusion portion 54 is coaxially aligned with the sheet portion 52 such that the sheet portion 52 matches the bottom surface 40 of the receiving tube 22. Optionally, the protrusion portion 54 includes recessed area. The sheet portion 52 provides a seal between the bottom plate 48 and the receiving tube 22. Additionally, the sheet portion 52 behaves as a stop for the protrusion portion 54 such that the protrusion portion 54 is not freely slidable within the receiving tube 22. Furthermore, the sheet portion 52 may have a plurality of weep holes 53. The weep holes 53 are located on the sheet portion 52 at the recessed area. As discussed above, the distal end of the bottom portion of the receiving tube 22 is not set in cement (see FIG. 5). In this regard, the bottom plate 48 having weep holes 53 are also not set in cement but is exposed to the gravel 47 (see FIG. 5). As a result, the weep holes 53 drain any moisture that might accumulate within the receiving tube 22. The number of weep holes 53 are increased as the requirement to drain moisture from the receiving tube 22 is increased.

More particularly, in relation to FIG. 5, the embodiment of the present invention as shown in FIGS. 2–5 is installed into the ground 11 in the following manner. A hole in the ground 11 is made which is approximately 18 inches deep and 18 inches round. Gravel 47 is placed at the bottom of the hole. Preferably, approximately six inches of gravel 47 is placed at the bottom of the hole. The bottom portion of the receiving tube 22 is inserted into the gravel 47. Preferably, approximately one inch of the bottom portion of the receiving tube 22 is inserted into the gravel 47. Cement is filled on top of the gravel 47 and surrounds the bottom portion of the receiving tube 22. Preferably, approximately six inches of cement is filled on top of the gravel 47. Dirt is filled on top of the cement. Preferably, approximately six inches of dirt is filled on top of the cement so that people will not hit the cement as the dirt is pushed out of the way after people repeatedly slide into the base 2 thereby pushing the soil away.

Referring to FIG. 3, a spring 90 is disposed within the aperture 24 of the receiving tube 22 between the bottom plate 48 and the cover 50. Preferably, the spring 90 is a compression spring, and the bottom of the spring 90 is nested within the recessed area of the protrusion portion 54 of the bottom plate 48. In this regard, the spring 90 biases the cover 50 flush with the upper surface 38 when the anchor 4 is removed from the receiving tube. The spring force must be sufficient to traverse the cover 50 from a retracted position to a position flush with upper surface 38. The spring force of the spring 90 with the base removed and the cover 50 at the flush position is approximately two pounds. The spring force at the retracted position is less than the weight of the base 2 and anchor 4, and is approximately 8 to 10 pounds of force. In this regard, the spring 90 cannot eject the anchor 4 and base 2 from the receiving tube 22. Additionally, the spring 90 does not bottom out when the anchor 4 is fully inserted therein.

The length of the receiving tube 22 is sufficient to contain the cover 50, spring 90 and anchor 4. The top of the spring 90 is nested in the recess of a housing 60 of the cover 50 at its bottom portion (see FIG. 3). Additionally, the spring 90 is positioned so as to be located in the recess of the protrusion portion 54 of the bottom plate 48. In this regard, the respective recesses are sized and configured to receive the spring 90. Both recesses are for the purpose of positioning the spring 90 within the receiving tube 22.

As shown in the embodiment of FIG. 3, a cord 92 is attached to the cover 50 and the bottom plate 48. Preferably, the cord 92 is placed through the spring 90. The cord 92 is attached to the cover 50 on the top end and attached to the bottom plate 48 on the bottom end. A purpose of the cord 92 is to regulate the cover 50 to the flushed position and to force the spring 90 into a biased, constantly tensioned, position. In particular, the spring 90 places the cord 92 in tension when the cover 50 is flush with the top surface 38. Another purpose of the cord 92 is to provide the spring 90, the bottom plate 48 and the cover 50 as one complete unit which may be removably inserted into the receiving lube 22. When the anchor 4 is inserted into the receiving tube 22, the cord 92 collapses into the spring 90.

Figure 4:
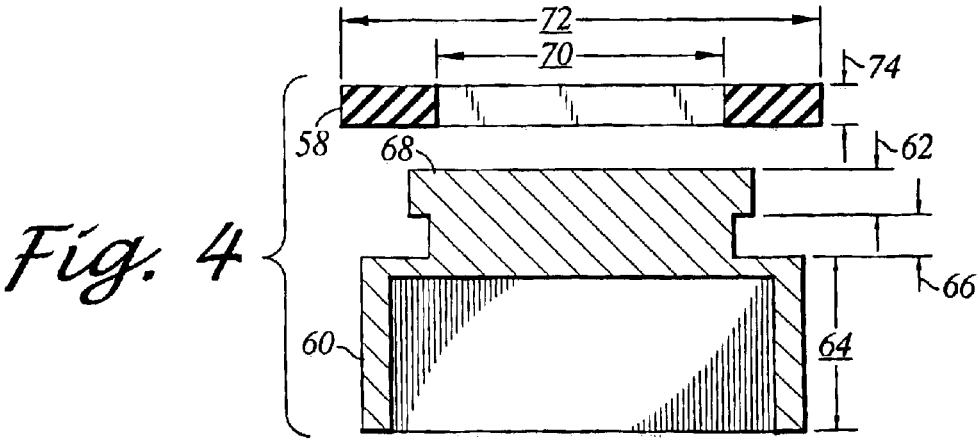
FIG. 4 is an exploded cross sectional view of the cover for the receiving tube.

Referring particularly to FIG. 4, there is shown a cross sectional exploded view of the cover 50 of the present invention. The cover 50 includes a seal 58 and the housing 60. The housing 60 is preferably a single unit which has a top and bottom portion 62, 64 separated by a groove 66. The top portion 62 has a top surface 68 which has a greater surface area compared to the cross-section of the anchor 4. In this regard, when the base 2 having the anchor 4 is inserted into the receiving tube 22, the seal 58 does not contact the anchor 4 thereby preventing any harm that might occur to the seal 58 from the anchor 4. The bottom portion 64 has a greater footprint than the top portion 62. The bottom portion 64 on its lower side has a recessed area which receives the spring 90 to locate the spring 90 within the receiving tube 22. By way of example and not limitation, the housing 60 may be manufactured from plastic, hard rubber or neoprene material.

Referring to FIG. 3, the seal 58 is affixed to the housing 60 at the groove 66. Generally, the seal 58 is manufactured from a resilient material. Preferably, the seal material is permeable to air and water but impermeable to dirt and other undesired debris. By way of example and not limitation, the seal 58 may be manufactured from foam, rubber, foam rubber, closed cell rubber or open cell rubber. Referring to FIG. 4, the seal 58 has an inside perimeter 70, an outside perimeter 72 and a thickness 74. The thickness 74 of the seal 58 is sized and configured to fit the width of the groove 66 on the housing 60. The inside perimeter 70 of the seal 58 is configured to be similar to the configuration of the groove 66 formed on the housing 60. The inside perimeter 70 of the seal 58 is sized such that it is slightly smaller than the groove 66. The outside perimeter 72 of the seal 58 is configured to be similar to the configuration of the inside surface 36 of the receiving tube 22. The outside perimeter 72 of the seal 58 is sized to be slightly larger than the inside surface 36 of the receiving tube 22 when the seal 58 is located on the groove 66 of the housing 60.

The cover 50 is inserted into the aperture 24 of the receiving tube 22, as shown in FIG. 2. In this regard, the cover 50 is made traversable between a position flush with the upper surface 38 and a retracted position when the anchor 4 is inserted into the receiving tube 22. FIG. 2 depicts the cover 50 being flush with the upper surface 38 of the receiving tube 22. The cover 50 is in the retracted position when the anchor 4 of the base 2 is inserted into the receiving tube 22 (not shown). The cover 50 is flush with the upper surface 38 when the anchor 4 of the base 2 is removed from the receiving tube 22.

As discussed above, the seal 58 is in direct contact with the inside surface 36 of the receiving tube 22. The significance of which is better appreciated in an example of the operation of the base system 18. In the operation of the base system 18, the anchor 4 of the base 2 is inserted into the receiving tube 22 when the field is being prepared for baseball. In this regard, a person will clear the top surface 38 of the receiving tube 22 and cover 50 from any debris or dirt thereon. Thereafter, the anchor 4 is inserted into the receiving tube 22. During the insertion, the cover 50 traverses the receiving tube 22 from the flush position with the upper surface 38 to a retracted position. During game time, players will step on and slide into the bases 2 which causes dirt and other debris to fall between the anchor 4 and the receiving tube 22. After the game, the anchor 4 is removed from the receiving tube 22 and placed in storage. During the removal, the cover 50 traverses the receiving tube 22 from the retracted position to a position flush with the upper surface 38, and any dirt or debris that may have fallen between the anchor 4 and the receiving tube 22 is ejected out from the receiving tube 22 by the cover 50. More specifically, by the seal 58 of the cover 50. In this regard, the seal 58 must apply a sufficient pressure continuously and circumferentially about the inside surface 36 of the receiving tube 22 to eject dirt and other debris out of the receiving tube 22 when the cover 50 traverses from the retracted to flushed position. Additionally, the inside perimeter 70 of the seal 58 must snugly fit in the groove 66 of the cover housing 60 such that repeated cycling of the cover 50 between the retracted position and the position flush with the upper surface 38 will not dislodge the seal 58 from the housing 60. As a result, only the top surface 38 of the receiving tube 22 and cover 50 need be cleared to re-insert the anchor 4 into the receiving tube 22. In contrast, in the prior art, dirt that has fallen into the receiving tube 22 needs to be cleared before the insertion of the anchor 4 therein. Additionally, in the prior art, the spoon 16 and rubber stopper 14 needs to be stored away; whereas, in the present invention, only the base 2 is detachable from the base securing device 20.

As stated above, the seal 58 is fabricated with material that is permeable to air but not to dirt or other undesirable debris. In this regard, the air is allowed to pass through the cover 50 such that the cover 50 may easily traverse the receiving tube 22 from the retracted position to a position flush with the upper surface 38. Conversely, when the anchor 4 is inserted into the receiving tube 22, the air trapped under the cover 50 within the receiving tube 22 must exit as the anchor 4 is inserted into the receiving tube 22. In this regard, the air may pass through the air permeable seal 58. Alternatively, the weep holes 53 provides an exit and entrance for air to pass into and out of the receiving tube 22.

As shown in FIG. 2 and 3, a locator 96 may be attached to the receiving tube 22. The locator 96 is a plurality of elongate bristles. The locator 96 is attached to the top of receiving tube 22 such that the top end of the locator 96 is visible above ground level when the anchor 4 is not inserted into the receiving tube 22. The locator 96 is fabricated from a resilient material in that it bends back when a base 2 is in place, and springs back up when the base 2 is removed. The color of the locator 96 may be any color which is easily locatable in the environment in which the base securing device 20 resides. By way of example and not limitation, the locator 96 may be orange when the base system 10 is used in a brown dirt field. In this regard, a purpose of the locator 96 is to make the location of the receiving tube 22 readily determinable when debris and dirt may be covering the receiving tube 22. Different colors may be used for different levels of play.

It should be noted and understood that with respect to the embodiments of the present invention, the materials suggested may be modified or substituted to achieve the general overall resultant high efficiency. The substitution of materials or dimensions remains within the spirit and scope of the present invention.

I claim:

1. A baseball base securing device to releaseably secure to a baseball base to an outdoor playing surface, said baseball base having a downwardly extending elongate anchor member, the device comprising:

a) a receiving tube defining an open top end, a buried bottom end and an interior sidewall surface, said open top end sized to receive a baseball base anchor;

b) a cover disposed within the receiving tube defining an outer circumference, the cover being traversable within said receiving tube between a first closed position at the open top end of the receiving tube and a second retracted position within the receiving tube; and c) a biasing member positioned within said receiving tube between said tube cover and the bottom end of said receiving tube, said biasing member adapted to force the cover upward to a closed position when the anchor of the baseball base is removed from the receiving tube.

2. The device of claim 1 wherein the biasing member is a compression spring.

3. The device of claim 1 wherein the biasing force of the biasing member at the retracted position is less than the total weight of the base and anchor.

4. The device of claim 2 further comprising a cord attached between the cover and the bottom of said receiving tube regulate the maximum compressive expanse of the spring.

5. The device of claim 1 wherein the outer circumference of the cover is in continuous contact with the interior sidewall surface of the receiving tube at rest and during movement of the cover within the receiving tube.

6. The device of claim 5 wherein the outer circumference of the cover incorporates a seal which contacts the interior side wall of the receiver and prevents unwanted debris from entering the interior of the receiving tube below the cover and which ejects debris when the cover reaches a closed position.

7. The device of claim 6 wherein the seal is permeable to air but impermeable to debris.

8. The device of claim 6 wherein the seal is manufactured from a material consisting of the group consisting of foam, rubber, foam rubber, closed cell rubber and open cell rubber.

9. The device of claim 1 further comprising a flexible elongate visual indicator affixed to the top end of the receiving tube.

10. The device of claim 9 wherein the visual indicator is fabricated from a resilient material.

11. The device of claim 1 further comprising an elongate bar affixed to the outer surface of said receiving tube in generally perpendicular relation to said receiving tube to aid in anchoring said receiving tube within the ground.

12. The device of claim 1 wherein the bottom portion of said receiving tube is embedded in gravel.

13. The device of claim 12 further comprising an elongate bar affixed to the outer surface of said receiving tube in generally perpendicular relation to said receiving tube to aid in anchoring said receiving tube within cement.

14. The device of claim 1 wherein the open top end of the receiving tube is sized to receive the and support the baseball base anchor such that the receiving tube provides a stable hold for the baseball base, but allows the passage of debris between said interior sidewalls of said receiving tube and the baseball base anchor when the device is in use.

* * * * *